US008503615B2

(12) United States Patent
Hockersmith et al.

(10) Patent No.: US 8,503,615 B2
(45) Date of Patent: Aug. 6, 2013

(54) ACTIVE THERMAL CONTROL OF X-RAY TUBES

(75) Inventors: Ron Kent Hockersmith, Waukesha, WI (US); Michael Hebert, Muskego, WI (US); Ian Strider Hunt, Sussex, WI (US); David Bateman, Milwaukee, WI (US)

(73) Assignee: General Electric Company, Schenectady, NY (US)

( * ) Notice: Subject to any disclaimer, the term of this patent is extended or adjusted under 35 U.S.C. 154(b) by 357 days.

(21) Appl. No.: 12/915,836

(22) Filed: Oct. 29, 2010

(65) Prior Publication Data

US 2012/0106709 A1 May 3, 2012

(51) Int. Cl.
*H01J 35/10* (2006.01)

(52) U.S. Cl.
USPC ..... 378/127; 378/130; 378/141

(58) Field of Classification Search
USPC ..... 378/130, 141, 127
See application file for complete search history.

(56) References Cited

U.S. PATENT DOCUMENTS

| | | | | |
|---|---|---|---|---|
| 3,836,214 | A | 9/1974 | Gengard et al. | |
| 4,072,875 | A * | 2/1978 | Webley | 378/125 |
| 4,736,400 | A | 4/1988 | Koller et al. | |
| 5,077,776 | A | 12/1991 | Vetter | |
| 5,654,999 | A | 8/1997 | Gemmel et al. | |
| 6,160,868 | A * | 12/2000 | Snyder et al. | 378/127 |
| 6,456,693 | B1 | 9/2002 | Ratzmann et al. | |
| 6,487,273 | B1 * | 11/2002 | Takenaka et al. | 378/142 |
| 6,491,428 | B1 * | 12/2002 | Takanashi | 378/200 |
| 6,980,628 | B2 | 12/2005 | Wang et al. | |
| 7,020,244 | B1 | 3/2006 | Wilson et al. | |
| 7,164,751 | B2 | 1/2007 | Weil | |
| 7,283,864 | B2 | 10/2007 | Thomas et al. | |
| 7,286,643 | B2 | 10/2007 | Hebert et al. | |
| 7,321,653 | B2 | 1/2008 | Hockersmith et al. | |
| 7,450,690 | B2 | 11/2008 | Block et al. | |
| 7,496,180 | B1 | 2/2009 | Subraya et al. | |
| 7,519,157 | B2 | 4/2009 | Hockersmith et al. | |
| 7,522,707 | B2 | 4/2009 | Steinlage et al. | |
| 7,558,375 | B2 | 7/2009 | Schaefer et al. | |
| 7,583,791 | B2 | 9/2009 | Hockersmith et al. | |
| 7,643,614 | B2 | 1/2010 | Hebert et al. | |
| 7,668,298 | B2 | 2/2010 | Subraya et al. | |
| 7,672,433 | B2 | 3/2010 | Zhong et al. | |
| 7,720,200 | B2 | 5/2010 | Steinlage et al. | |
| 7,796,737 | B2 | 9/2010 | Allen et al. | |

(Continued)

FOREIGN PATENT DOCUMENTS

| | | |
|---|---|---|
| WO | 2010046837 | 4/2010 |
| WO | 2010061323 | 6/2010 |

*Primary Examiner* — Glen Kao
(74) *Attorney, Agent, or Firm* — Fletcher Yoder, P.C.

(57) ABSTRACT

The present embodiments relate to active thermal control of X-ray tubes. In one embodiment, a system includes an X-ray tube having an electron beam target, a rotary bearing supporting the target in rotation, and a coolant flow passage, at least a portion of the coolant flow passage being disposed in the center of the rotary bearing, and the coolant flow passage is configured to receive a coolant. The system also includes a coolant circulating system coupled to the coolant flow passage and configured to circulate the coolant thorough the coolant flow passage, and a control circuit coupled to the coolant circulating system and the rotary bearing, the control circuit being configured to control heat flow between components of the X-ray tube by regulating extraction of heat from the X-ray tube via the coolant and by regulating a rotation rate of the rotary bearing.

26 Claims, 5 Drawing Sheets

(56) References Cited

U.S. PATENT DOCUMENTS

| | | | |
|---|---|---|---|
| 7,809,101 | B2 | 10/2010 | Frutschy et al. |
| 7,869,572 | B2 | 1/2011 | Allen et al. |
| 7,869,574 | B2 | 1/2011 | Steinlage et al. |
| 7,903,786 | B2 | 3/2011 | Zhong et al. |
| 7,933,382 | B2 | 4/2011 | Hunt et al. |
| 7,974,384 | B2 | 7/2011 | Legall et al. |
| 8,121,259 | B2 | 2/2012 | Hebert et al. |
| 8,166,432 | B2 | 4/2012 | Kosugi |
| 8,270,562 | B2 | 9/2012 | Sainath et al. |
| 2005/0135561 | A1 | 6/2005 | Hebert et al. |
| 2005/0226386 | A1 | 10/2005 | Wang et al. |
| 2007/0007874 | A1 | 1/2007 | Block et al. |
| 2007/0041504 | A1 | 2/2007 | Hockersmith et al. |
| 2007/0071174 | A1 | 3/2007 | Hebert et al. |
| 2008/0069306 | A1 | 3/2008 | Hockersmith et al. |
| 2008/0101541 | A1 | 5/2008 | Steinlage et al. |
| 2008/0107238 | A1 | 5/2008 | Steinlage et al. |
| 2008/0260102 | A1 | 10/2008 | Steinlage et al. |
| 2008/0260105 | A1 | 10/2008 | Schaefer et al. |
| 2009/0052627 | A1 | 2/2009 | Subraya et al. |
| 2009/0060140 | A1 | 3/2009 | Subraya et al. |
| 2009/0080615 | A1 | 3/2009 | Hebert et al. |
| 2009/0086919 | A1 | 4/2009 | Steinlage et al. |
| 2009/0279668 | A1 | 11/2009 | Allen et al. |
| 2009/0279669 | A1 | 11/2009 | Allen et al. |
| 2009/0285363 | A1 | 11/2009 | Zhong et al. |
| 2009/0304158 | A1 | 12/2009 | Frutschy et al. |
| 2010/0046717 | A1 | 2/2010 | Zhong et al. |
| 2010/0092699 | A1 | 4/2010 | Steinlage et al. |
| 2010/0128848 | A1 | 5/2010 | Qiu et al. |
| 2010/0246773 | A1 | 9/2010 | Hunt et al. |
| 2010/0260323 | A1 | 10/2010 | Legall et al. |
| 2011/0007872 | A1 | 1/2011 | Steinlage et al. |
| 2011/0135067 | A1 | 6/2011 | Hebert et al. |
| 2011/0150174 | A1 | 6/2011 | Sainath et al. |
| 2011/0176659 | A1 | 7/2011 | Rogers et al. |

* cited by examiner

ACTIVE THERMAL CONTROL OF X-RAY TUBES

BACKGROUND OF THE INVENTION

The subject matter disclosed herein relates to X-ray tubes used in medical imaging and, in particular, to the thermal control of X-ray tubes.

In non-invasive imaging systems, X-ray tubes are used in fluoroscopy, projection X-ray, tomosynthesis, and computer tomography (CT) systems as a source of X-ray radiation. Typically, the X-ray tube includes a cathode and a target. A thermionic filament within the cathode emits a stream of electrons towards the target in response to heat resulting from an applied electrical current, with the electrons eventually impacting the target. Once the target is bombarded with the stream of electrons, it produces X-ray radiation and heat.

The X-ray radiation traverses a subject of interest, such as a human patient, and a portion of the radiation impacts a detector or photographic plate where the image data is collected. Generally, tissues that differentially absorb or attenuate the flow of X-ray photons through the subject of interest produce contrast in a resulting image. In some X-ray systems, the photographic plate is then developed to produce an image which may be used by a radiologist or attending physician for diagnostic purposes. In digital X-ray systems, a digital detector produces signals representative of the received X-ray radiation that impacts discrete pixel regions of a detector surface. The signals may then be processed to generate an image that may be displayed for review. In CT systems, a detector array, including a series of detector elements, produces similar signals through various positions as a gantry is displaced around a patient.

The X-ray tube has a useful life over a large number of examination sequences, and must generally be available for examination sequences upon demand in a medical care facility, as examination sequences may or may not be scheduled, for example due to emergency situations. When the X-ray tube is not in use, the X-ray tube may cool between imaging sequences, as no electrons are being emitted by the thermionic element (i.e., substantially no heat is being generated). This cooling may result in the target material dropping below its ductile to brittle transition temperature, which can result in fracture of the target or reduced operating life. Existing techniques to warm X-ray tubes are often unreliable and inefficient, as typical thermal transition processes may take up to one hour and can over or undershoot a desired target temperature, resulting in instability of the target material. In such cases, image sequences may be delayed or, in cases where imaging sequences are performed before the target is properly warmed, the target may rupture. Accordingly, a need exists for improved thermal control in X-ray tubes.

BRIEF DESCRIPTION OF THE INVENTION

In one embodiment, a system for thermal control of an X-ray tube is provided. The system includes an X-ray tube having an electron beam target, a rotary bearing supporting the target in rotation, and a coolant flow passage, at least a portion of the coolant flow passage being disposed in the center of the rotary bearing, and the coolant flow passage is configured to receive a coolant. The system also includes a coolant circulating system coupled to the coolant flow passage and configured to circulate the coolant thorough the coolant flow passage, and a control circuit coupled to the coolant circulating system and the rotary bearing, the control circuit being configured to control heat flow between components of the X-ray tube by regulating extraction of heat from the X-ray tube via the coolant and by regulating a rotation rate of the rotary bearing.

In another embodiment, an imaging system is provided. The system includes a system for thermal control of an X-ray tube having an X-ray tube having an electron beam target, a rotary bearing supporting the target in rotation, and a coolant flow passage, at least a portion of the coolant flow passage being disposed in the center of the bearing, and the coolant flow passage is configured to receive a coolant. The thermal control system also includes a coolant circulating system coupled to the coolant flow passage and configured to circulate the coolant thorough the coolant flow passage. The imaging system further includes a digital detector configured to receive radiation from the X-ray tube transmitted through a subject of interest, an image acquisition circuit configured to control acquisition of image data from the detector; and a control circuit coupled to the coolant circulating system and the rotary bearing, the control circuit being configured to control heat flow between components of the X-ray tube by regulating the extraction of heat from the X-ray tube via the coolant and by regulating a rotation rate of the rotary bearing.

In a further embodiment, a method for thermal control of an X-ray tube is provided. The method generally includes rotating a rotary bearing supporting an electron beam target in rotation at a rotation rate to generate heat, regulating extraction of heat from the electron beam target, the rotary bearing, or both, via coolant circulated through the X-ray tube, and monitoring a parameter indicative of a temperature within the X-ray tube.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The present approaches are directed towards a system and method for controlling the temperature of various components within an X-ray tube. For example, in embodiments of an X-ray tube wherein the target is rotatably connected to a spiral groove bearing, it may be possible to rotate the target at such a rate, and to control other process variables so as to control the amount of thermal energy that is withdrawn from the target by coolant that is circulating through the X-ray tube. This control of thermal energy withdrawal may be possible due to the thermal energy generated from the spiral groove bearing, which may include a liquid metal lubricant disposed between at least a portion of a fixed shaft and a rotating element to which the target is connected. The liquid metal lubricant may generate thermal energy during rotation. In a general sense, as the rotational speed of the target increases, the amount of thermal energy produced by the spiral groove bearing increases.

In addition to thermal control of the X-ray tube via the control of rotational speed of the spiral groove bearing, the present approaches are also directed towards thermal control via a control system that includes any one or a combination of the motor to which the spiral groove bearing is connected, a heat exchanger (HX), a coolant pump, and a valve that controls the amount of coolant that flows through portions of the X-ray tube. The control system may control the entire X-ray imaging system, or may be a separate control system that is connected to the main control system of the X-ray imaging system. The thermal control system may utilize a feedback and/or modeling mechanism to determine which operational parameters may be manipulated to control the temperatures of various components within the tube, such as spiral groove bearing rotation speed, coolant flow rate, coolant temperature, and so on. For example, the thermal control system may utilize a temperature model to predict the actual temperature of various X-ray tube components in vacuo, and adjust operational parameters in response to the modeled temperatures. In related embodiments, the thermal control system may utilize actual temperature readings of the X-ray tube components in lieu of or in addition to the modeled temperatures. In some embodiments, the control system may control the flow of thermal energy between components of the X-ray tube.

Figure 1:
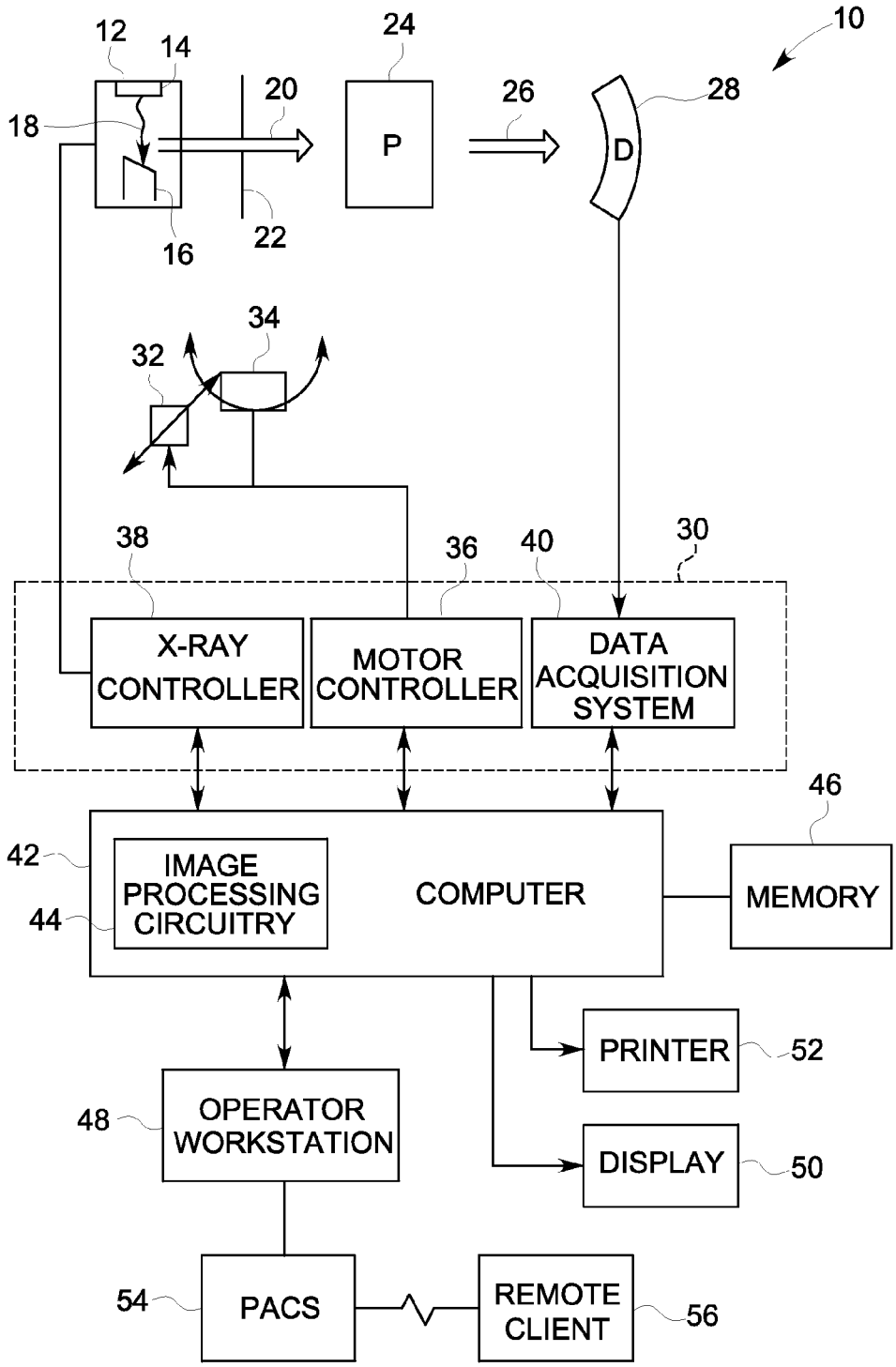
FIG. 1 is a system-level view of an embodiment of an imaging system in the form of a CT imaging system in which the temperature of the X-ray source is actively controlled, in accordance with embodiments of the present disclosure.

The thermal control system may be utilized in any X-ray tube, such as X-ray tubes utilized in fluoroscopy imaging systems, CT imaging systems, and so on. FIG. 1 illustrates such an imaging system 10 for acquiring and processing image data, and is one embodiment in which thermal control according to the present approaches may be utilized. In the illustrated embodiment, system 10 is a computed tomography (CT) system designed to acquire X-ray image data, to reconstruct a tomographic image based upon the data, and to process the image data for display and analysis. Though the imaging system 10 is discussed in the context of medical imaging, the techniques and configurations discussed herein are applicable in other non-invasive imaging contexts, such as baggage or package screening or industrial nondestructive evaluation of manufactured parts.

Figure 2:
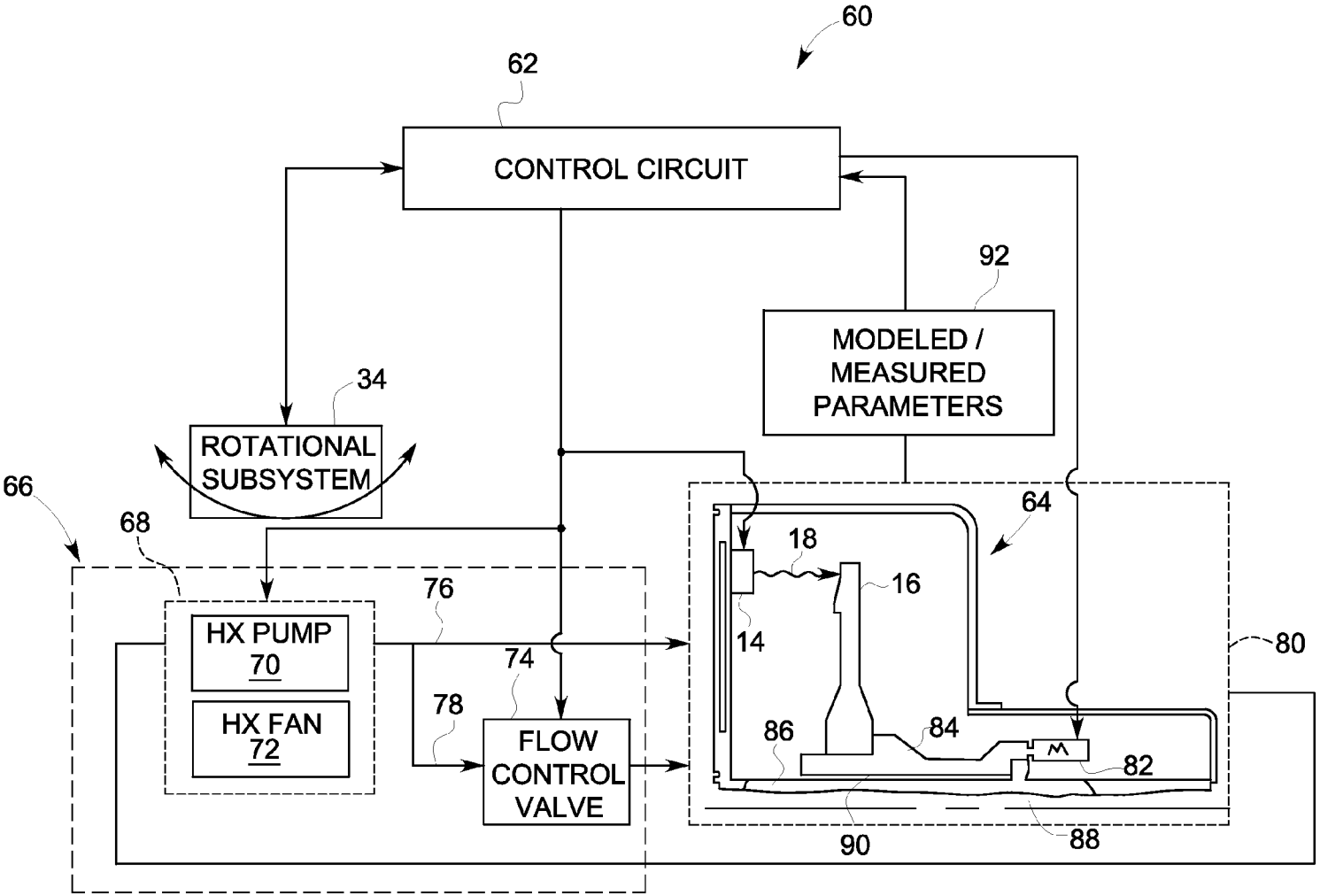
FIG. 2 is a schematic illustration of an embodiment of a thermal control system for actively controlling the temperature of an X-ray tube, in accordance with embodiments of the present disclosure.
Figure 3:
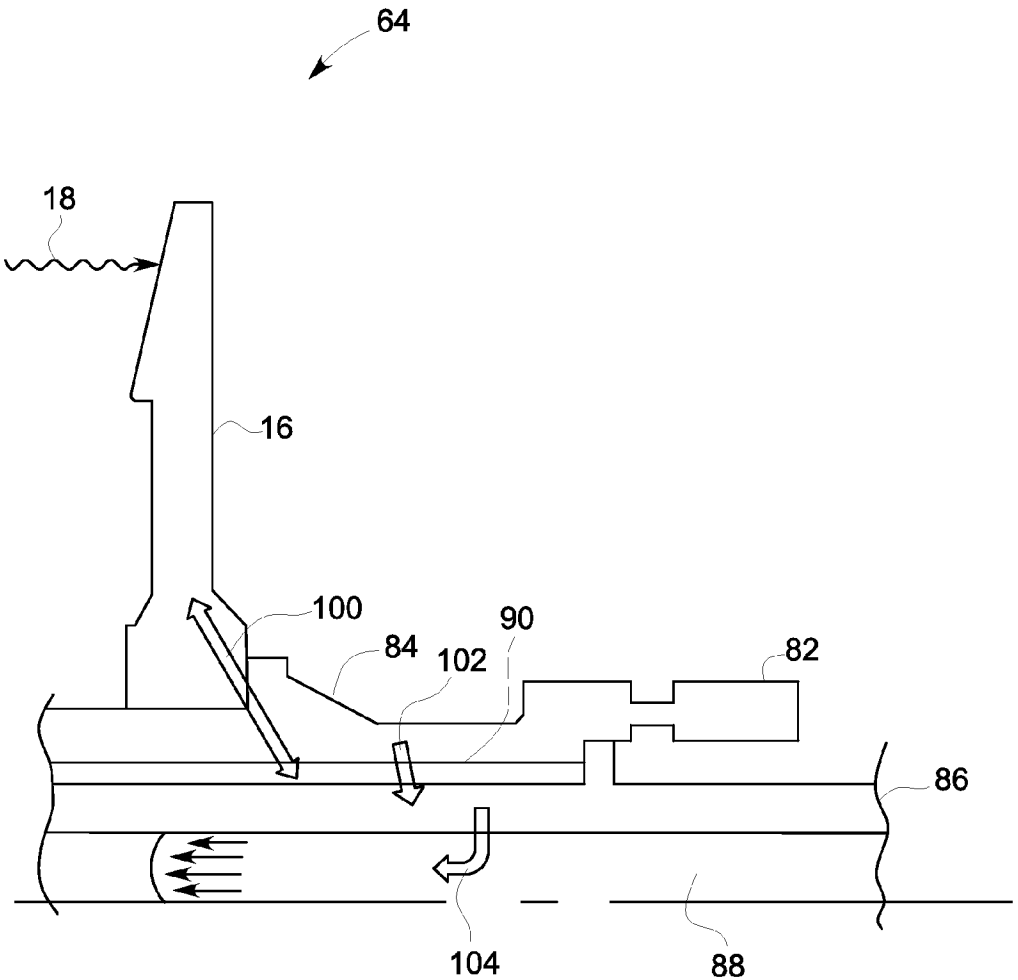
FIG. 3 is a schematic illustration of heat transfer between the components of the X-ray tube of FIG. 2 during operation of the thermal control system, in accordance with embodiments of the present disclosure.

In the embodiment illustrated in FIG. 1, the CT imaging system 10 includes an X-ray source 12, which may be thermally controlled in accordance with present embodiments, and is described in further detail below with respect to FIGS. 2 and 3. As discussed in detail below, the source 12 may include one or more X-ray tubes. For example, the source 12 may include an X-ray tube with a cathode assembly 14 and a target 16 as described in more detail with respect to FIG. 2 below. The cathode assembly 14 accelerates a stream of electrons 18 (i.e., the electron beam) toward a target 16. According to present embodiments, the target 16 is rotatably coupled to a spiral groove bearing. The spiral groove bearing is advantageously lubricated with liquid metal, as discussed in detail below.

During operation, the target 16 rotates, which allows the stream of electrons 18 to impact different portions of the target 16 to prevent deformation and overheating of the target 16. The impact of the stream of electrons 18 on the target 16 causes the material of the target 16 to emit an X-ray beam 20. In addition to the X-ray beam 20, a large amount of thermal energy is generated during electron bombardment of the target 16, which heats the surface of the target. The temperature of the target 16, and by extension the source 12, may be controlled by a thermal control system, as described in further detail below. In a general sense, the thermal control system regulates the flow of coolant through one or more parts of the source 12. In combination with the liquid metal lubricated spiral groove bearing, which may generate heat when rotated, the thermal control system may allow thermal maintenance of the source 12 between uses (i.e., between imaging exposures).

The source 12 may be positioned proximate to a collimator 22 used to define the size and shape of the one or more X-ray beams 20 that pass into a region in which a subject 24 or object is positioned. Some portion of the X-ray beam is absorbed or attenuated by the subject 24 and the resulting X-rays 26 impact a detector array 28 formed by a plurality of detector elements. Each detector element produces an electrical signal that represents the intensity of the X-ray beam incident at the position of the detector element when the beam strikes the detector 28. Electrical signals are acquired and processed to generate one or more scan datasets.

A system controller 30 commands operation of the imaging system 10 to execute examination and/or calibration protocols and to process the acquired data. With respect to the X-ray source 12, the system controller 30 furnishes power, focal spot location, rotational speed of the target 16, control signals and so forth, for the X-ray examination sequences. In some embodiments, the system controller 30 may include a thermal control system for controlling the temperature of one or more of the components within the X-ray source 12, as discussed below. The detector 28 that receives the portion of the X-rays 26 from the source 12 is coupled to the system controller 30, which commands acquisition of the signals generated by the detector 28.

The system controller 30 may control the movement of a linear positioning subsystem 32 and a rotational subsystem 34 via a motor controller 36. In an embodiment where the imaging system 10 includes rotation of the source 12 and/or the detector 28, the rotational subsystem 34 may rotate the source 12, the collimator 22, and the detector 28 about the subject 24. It should be noted that the rotational subsystem 34 might include a gantry having both stationary components (stator) and rotating components (rotor). The linear positioning subsystem 32 may enable the subject 24, or more specifically a patient table that supports the subject 24, to be displaced linearly. Thus, the patient table may be linearly moved within the gantry or within an imaging volume (e.g., the volume located between the source 12 and the detector 28) and enable the acquisition of data from particular areas of the subject 24 and, thus the generation of images associated with those particular areas. Additionally, the linear positioning subsystem 32 may displace the one or more components of the collimator 22, so as to adjust the shape and/or direction of the X-ray beam 20. In embodiments in which the source 12 and the detector 28 are configured to provide extended or sufficient coverage along the z-axis (i.e., the axis associated with the main length of the subject 24) and/or linear motion of the subject is not required, the linear positioning subsystem 34 may be absent.

The system controller 30 may include signal processing circuitry and associated memory circuitry. In such embodiments, the memory circuitry may store programs, routines, and encoded algorithms executed by the system controller 30 to operate the imaging system 10, including the X-ray source 12 and associated thermal control system, and to process the data acquired by the detector 28. In one embodiment, the system controller 30 may be implemented as all or part of a processor-based system such as a general purpose or application-specific computer system.

The source 12 may be controlled by an X-ray controller 38 contained within the system controller 30. The X-ray controller 38 may be configured to provide power and timing signals to the source 12. In addition, in some embodiments the X-ray controller 38 may be configured to selectively activate the source 12 such that tubes or emitters at different locations within the system 10 may be operated in synchrony with one another or independent of one another. According to the approaches described herein, the X-ray controller 38 may modulate activation or operation the thermionic emitter contained within the cathode assembly 14 and the rotational speed of the target 16 to thermally regulate the source 12, as described below. Further, the X-ray controller 38 and/or system controller 30 may adjust coolant flow through portions of the source 12 to modulate the removal of thermal energy from the X-ray source 12. For example, the X-ray controller 38 and/or system controller 30 may be configured to execute code for modeling the temperature of portions of the source 12 (e.g., the target 16) and for performing adjustments to rotation speed, thermionic emission, coolant flow, and so forth.

The system controller 30 may include a data acquisition system (DAS) 40. The DAS 40 receives data collected by readout electronics of the detector 28, such as sampled analog signals from the detector 28. The DAS 40 may then convert the data to digital signals for subsequent processing by a processor-based system, such as a computer 42. In other embodiments, the detector 28 may convert the sampled analog signals to digital signals prior to transmission to the data acquisition system 40. The computer 42 may include or communicate with one or more suitable memory devices 46 that can store data processed by the computer 42, data to be processed by the computer 42, or routines and/or algorithms to be executed by the computer 42. The computer 42 may be adapted to control features enabled by the system controller 30 (i.e., scanning operations, data acquisition, and thermal regulation), such as in response to commands and scanning parameters provided by an operator via an operator workstation 48. From the workstation 48, the operator may input various imaging routines and other routines such as X-ray source 12 warm up routines and temperature maintenance routines.

The system 10 may also include a display 50 coupled to the operator workstation 48 that allows the operator to view relevant system data, imaging parameters, raw imaging data, reconstructed data, and so forth. Additionally, the system 10 may include a printer 52 coupled to the operator workstation 48 and configured to print any desired measurement results. The display 50 and the printer 52 may also be connected to the computer 42 directly or via the operator workstation 48. Further, the operator workstation 48 may include or be coupled to a picture archiving and communications system (PACS) 54. PACS 54 may be coupled to a remote system 56, radiology department information system (RIS), hospital information system (HIS) or to an internal or external network, so that others at different locations can gain access to the image data.

As noted above, the present embodiments are directed towards active thermal control of the X-ray source 12. In accordance with one aspect of the embodiments disclosed herein, the active thermal control may be performed using control circuitry that is connected to one or more components of the system 10 that may affect the temperature of the source 12. Together, the control circuitry and associated components may form a thermal control system, an embodiment of which is depicted in FIG. 2. Specifically, FIG. 2 illustrates a thermal control system 60 having a control circuit 62 connected to various components of the X-ray source 12, which in the depicted embodiment is an X-ray tube 64 and is discussed below. In a general sense, the control circuit 62 is configured to regulate thermal energy transfer between components of the X-ray tube 64. The control circuit 62 is also connected to the rotational subsystem 34, which may be a gantry as described above.

The control circuit 62, in the illustrated embodiment, is connected to a coolant circulating system 66 configured to circulate coolant through and/or around the X-ray tube 64. Components of the coolant circulating system 66 include a heat exchanger 68 having a coolant pump 70 (e.g., a variable speed or single speed pump) and a heat exchanging fan 72, and a device for controlling the flow of coolant, such as a flow control valve 74 (e.g., a choke valve). The heat exchanger 68 utilizes the coolant pump 70 to motivate amounts (e.g., variable amounts or substantially continuous amounts) of coolant through one or more paths that may pass through and/or around the X-ray tube 64. Additionally, the heat exchanger 68 uses the heat exchanging fan 72 to control the amount of heat rejection from the coolant (i.e., the temperature of the coolant). In this way, both the mass flow rate of the coolant and the coolant temperature may be controlled by the control circuit 62. That is, the control circuit 62 may send control signals to the heat exchanging fan 72 and/or to the coolant pump 70 to control the amount of heat rejection from the coolant and the flow rate of the coolant, respectively. Likewise, flow control valve 74 may be controlled by the control circuit 62 to adjust the amount of coolant flowing through and/or around various components of the X-ray tube 64, including through a central shaft of the tube. For example, the control circuit 62 may send control signals that adjust the position of the flow control valve 74 to controllably divert a portion of the coolant flow from a main coolant path 76 to a secondary coolant path 78, which may result in a portion of coolant flow being diverted from one area of the X-ray tube 64 to another. Moreover, it should be noted that the flow control valve 74, or other features utilized to control the flow of coolant through and/or around components of the X-ray tube 64, may be positioned at any point around an X-ray tube control volume 80 encompassing the X-ray tube 64, such as at a coolant outlet from the X-ray tube control volume 80.

The X-ray tube control volume 80 generally defines the area in which coolant may flow to affect the temperature of one or more components of the X-ray tube 64. The X-ray tube control volume 80 may include the X-ray tube 64 and the components contained therein, as well as flow paths, conduits, cooling jackets, and so on that may experience varying levels of coolant flow and coolant temperature for thermal regulation. Components of the X-ray tube 64 that may be considered part of the X-ray tube control volume 80, i.e., components that may affect the temperature of one or more components of the X-ray tube 64, include a motor 82 that controls the rotation of a sleeve 84 to which the target 16 is attached for rotation, and a stationary shaft 86 about which the sleeve 84 rotates, and which also includes a coolant flow path 88. In the illustrated embodiment, the coolant flow path 88 runs substantially along a longitudinal center opening of the stationary shaft 86, and allows coolant to remove thermal energy from the stationary shaft 86 and, therefore, the components that may be in direct connection and/or thermal communication with the stationary shaft 86. According to present embodiments, by controlling the mass flow rate and/or temperature of the coolant, the rate at which the X-ray tube 64 and, thus, the target 16 is cooled may be faster than embodiments in which such a thermal control system is absent. Such faster cooling may allow for higher peak power scanning, which may reduce image noise produced at fast gantry speeds.

According to certain embodiments, the bearing formed by the rotary sleeve 84 and the stationary shaft 86 may be a spiral groove bearing (SGB) 90 that is lubricated with a liquid metal material, i.e., materials that are liquid metal at room temperature, such as gallium (Ga) and/or Ga alloys. Indeed, some embodiments of the bearing 90 may conform to those described in U.S. patent application Ser. No. 12/410,518 entitled "INTERFACE FOR LIQUID METAL BEARING AND METHOD OF MAKING SAME," filed on Mar. 25, 2009, the full disclosure of which is incorporated by reference herein in its entirety. For the purposes of the present discussion, the SGB 90 may also be referred to as the interface between the sleeve 84 and the stationary shaft 86, which is the area containing the liquid metal material and the area where shear forces are applied to the liquid metal material. Advantageously, during rotation of the SGB 90, the liquid metal material generates thermal energy that heats the SGB 90. Such heating may transfer thermal energy to proximal X-ray tube components and/or reduce the amount of thermal energy withdrawn from the X-ray tube components by the coolant flowing through the X-ray tube control volume 80. Conversely, the present embodiments also allow for enhanced cooling of the liquid metal material, which may increase the load-bearing capacity of the SGB 90. In such embodiments, the SGB 90 may support increased rotation speeds of the rotational subsystem 34 due to its ability to remain substantially stable under increased centrifugal forces. In embodiments where the rotational subsystem 34 includes a gantry, the present approaches may allow the rotational speed of the gantry to be increased by between about 5% and about 20% (e.g., between about 5% and 15%).

Additionally, in some embodiments, the X-ray tube control volume 80 may include the thermionic emitter 14 of the X-ray tube 64 to which the control circuit 62 may be connected, either directly or indirectly. In such a configuration, the control circuit 62 may control the flux of the electron beam 18 generated by the thermionic emitter 14, which allows the control circuit 62 to control the rate at which the target 16 is heated. However, it should be noted that the flux of the electron beam 18 may be determined based upon the parameters of a given imaging sequence in addition to or in lieu of the desired heating rate. In this way, there may be situations where the flux of the electron beam 18 suitable for a given imaging sequence may also correspond to a desired heating rate. This may allow the control circuit 62 to at least partially control the actual temperature of the target 16 and the X-ray tube components proximal thereto. Heat transfer between X-ray tube components is described further below with respect to FIG. 3.

In operation, the control circuit 62 may control any one or a combination of the above-mentioned components to control the temperature of the X-ray tube 64, for example in response to feedback 92 received from the X-ray tube control volume 80. The feedback 92 may include various temperatures, such as one or more modeled and/or measured parameters within the X-ray tube 64. As an example, the modeled and/or measured parameters may include the temperatures of the target 16, the temperature of the SGB 90, and/or the temperature of the rotor 84, to name a few. The feedback 92 may be modeled (e.g., time series models, finite difference models) or may be measured feedback, or a combination. The control circuit 62 may also control the operation of one or more of the components of the thermal control system 60 in response to other factors. These factors may include the rotation speed of the rotational subsystem 34 (e.g., gantry speed), the centrifugal forces on the SGB 90, the rotation rate of the SGB 90, as well as the mode of operation of the X-ray tube 64, such as when the X-ray tube 64 is warmed up, cooled down, performing an imaging routine, and/or between imaging routines. Such methods for controlling temperatures of components within the X-ray tube 64 are described in further detail below with respect to FIGS. 4 and 5. In some embodiments, the control circuit 62 may include a programmable logic controller (PLC) that utilizes one or more algorithms to perform the thermal regulation process, such as a proportional-integral-derivative (PID) or proportional-integral (PI) algorithm.

As noted above, the present embodiments are directed towards the utilization of heat-generating and heat-withdrawing features to actively regulate the temperature of and thermal energy transfer between various components within the X-ray tube 64. Specifically, the thermal control system 60 of FIG. 2 may not only control the amount of thermal energy withdrawn by coolant as described above, but may also control the amount and direction of thermal energy transfer between components of the X-ray tube 64. FIG. 3 illustrates schematically the thermal energy transfer between various components of the X-ray tube 64 during operation.

In a general sense, thermal energy may be imparted to components of the X-ray tube 64 by the bombardment of the electron beam 18 on the target 16 and by rotation of the SGB 90. As noted above, bombardment of the electron beam 18 on the target 16 results in the generation of both X-rays and thermal energy, and rotation of the SGB 90 creates shear forces on the liquid metal lubricant material, which also generates thermal energy. As an example, thermal energy generation from the SGB 90 ranging from about 50 W to about 1000 W may be possible, depending on the rotation rate of the SGB 90 and the speed of the rotational subsystem 34, which is illustrated by one direction of bi-directional arrow 100. The thermal energy generated from bombardment of the target 16 with the electron beam 18 may generally travel through the target 16 and towards the sleeve 84, as represented by another direction of the bi-directional arrow 100. Thermal energy generated at the target 16 that is transferred to the sleeve 84 may be further transferred through the SGB 90 to the stationary shaft 86, as represented by arrow 102.

To remove thermal energy from the above-mentioned components, coolant flows through the coolant flow path 88 in the center of the stationary shaft 86, and acts as a heat sink to remove thermal energy from the stationary shaft 86 and its nearby components, as represented by arrow 104. According to the present approaches, the SGB 90 may be used as a thermal gate that controls the amount of thermal energy that is transferred from the sleeve 84 to the coolant flow path 88. For example, by varying the rotational speed of the SGB 90, the thermal energy produced by the SGB 90 may vary, which allows the cooling effect of the coolant on (i.e., the thermal energy withdrawal from) the target 16, the sleeve 84, and the stationary shaft 86 to be at least partially tuned. That is, the SGB 90 may create a surplus of thermal energy that must be removed before the target 16 may begin to cool. These approaches, in combination with mass flow and temperature control of the coolant, may be desirable to maintain the temperature of the target 16 above the ductile to brittle transition temperature (DBTT) such that the target 16 is stable (i.e., does not fracture) during operation.

During periods when the target 16 is at a temperature lower than the sleeve 84, such as at the beginning of a day or prior to performing an imaging routine, the thermal energy generated by rotation of the SGB 90 may travel towards the target 16, as represented by bi-directional arrow 100. For example, the control circuit 62 may provide control signals to the motor 82, either directly or indirectly, to control the rate of rotation of the SGB 90. The SGB 90 may then generate thermal energy, which may be transferred through the sleeve 84 and to the target 16. Of course, in these situations, the level of cooling by the coolant may be adjusted by adjusting the amount of heat rejection from the coolant at the heat exchanger 66 (FIG. 2) and/or adjusting the coolant mass flow rate. The control of the flow rate may, in turn, include control of output of the coolant circulating pump 70 or control of the flow control valve 74, or both.

Figure 4:
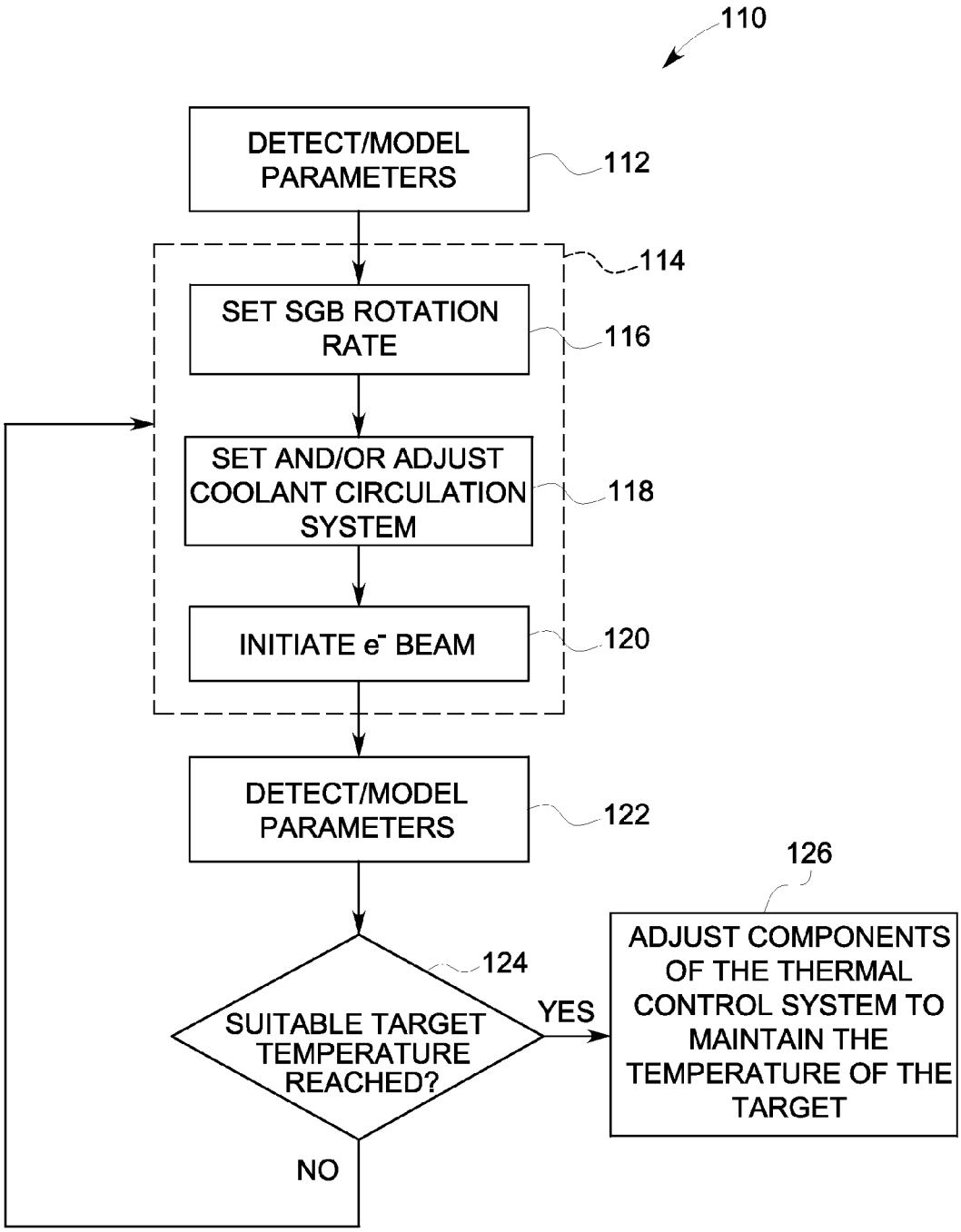
FIG. 4 is a process flow diagram illustrating an embodiment of a method for preparing an X-ray tube for imaging, in accordance with embodiments of the present disclosure.
Figure 5:
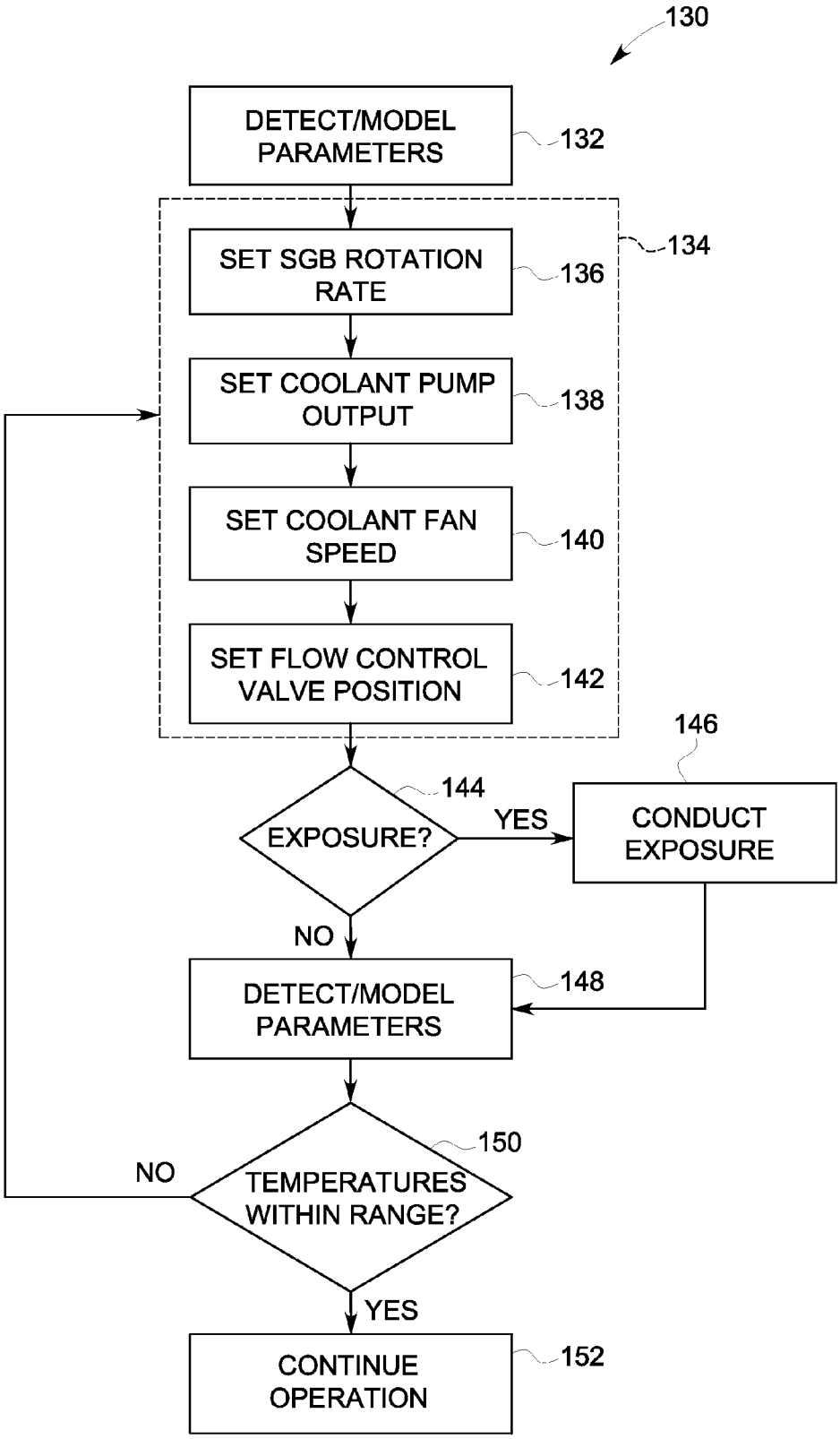
FIG. 5 is a process flow diagram illustrating an embodiment of a method for maintaining the temperatures of components within an X-ray tube during and between imaging routines, in accordance with embodiments of the present disclosure.

As noted above, these control routines may be performed by the control circuit 62 prior to, during, and/or after imaging routines. Examples of methods to thermally regulate the temperature of the X-ray tube 64 and its components (e.g., the target 16) are provided below. Specifically, FIG. 4 illustrates a method for warming up a target prior to performing imaging routines, and FIG. 5 illustrates a method for temperature maintenance of the X-ray tube 64 during and between imaging routines.

As noted above, at the beginning of a day, or prior to performing an imaging routine, the temperature of the target 16 within the X-ray tube 64 may be below a suitable operating temperature. For example, the target 16 may be at or slightly above room temperature, which may be below the ductile to brittle transition temperature (DBTT) of the target material of the target 16. Utilization of the X-ray tube 64 at such temperatures may damage the target 16. Accordingly, it may be desirable to perform a warm-up routine to bring the target 16 to a suitable operating temperature and/or maintain the temperature of the target 16 at a suitable operating temperature. FIG. 4 illustrates a process flow diagram of an embodiment of such a method 110 for achieving a suitable operational temperature for an X-ray tube prior to use, while FIG. 5 illustrates a process flow diagram of an embodiment of a method for maintaining a suitable operational temperature during and between uses.

Method 110 may be performed by the thermal control system 60, which may be controlled by the control circuit 62 (i.e., the method 110 or parts thereof may be implemented by software). Indeed, the control circuit 62 may automatically perform the acts of method 110, or certain steps may be initiated by a user. Method 110 generally begins with various parameters being detected and/or modeled (block 112), the feedback of which is provided to the control circuit 62. As discussed above, the feedback may determine various operational parameters such as SGB 90 rotation rate, electron beam 18 flux, coolant flow rates and temperatures, and so on. The acts represented by block 112 may include detecting and/or modeling various temperatures of the components within the X-ray tube 64 such as the target 16, the sleeve 84, the stationary shaft 86, and the SGB 90. Further, as discussed above with respect to FIGS. 2 and 3, other parameters may be directly measured, such as the coolant temperature and/or coolant flow rate.

It should be noted that during downtime of the X-ray imaging system (e.g., overnight), such as system 10, that the SGB 90 may maintain a relatively constant rotation speed. That is, the SGB 90 may be rotating at a substantially constant rate prior to the acts of method 110. However, in other situations, such as during maintenance, the SGB 90 may not be rotating. Keeping this in mind, once the desired parameters have been detected and/or modeled, the control circuit 62 may adjust one or more operational parameters 114. For example, in the illustrated embodiment of FIG. 4, the control circuit 62 may send control signals to the motor 82 to set and/or adjust the rotation rate of the SGB 90 (block 116). As noted above, the rotation rate of the SGB 90 may determine the amount of thermal energy produced by the liquid metal material experiencing shear forces.

In addition to beginning the rotation of the SGB 90, the control circuit 62 may send control signals to set and/or adjust operational parameters of the coolant circulation system 66 (block 118). The control circuit 62 may adjust the coolant circulation system 66 by sending control signals to the coolant pump 70 and the heat exchanging fan 72 to adjust the coolant mass flow rate and coolant heat rejection, respectively, and to the flow control valve 74 to adjust the coolant mass flow rate through various parts of the X-ray tube 64 (block 118). As an example, the position of the flow control valve 74 may determine the amount of coolant that flows through the coolant flow path 88 in the center of the stationary shaft 86 and the amount of coolant that circulates around an outer perimeter of the X-ray tube 64. The control circuit 62 may adjust any one or a combination of the components of the X-ray tube 64 and the components of the coolant circulation system 66 to arrive at a suitable operating temperature. Moreover, in situations where the coolant circulation system 66 is flowing a substantially constant rate and/or temperature of coolant prior to performance of method 100, the control circuit 62 may send control signals to that cause the coolant circulation system 66 to adjust its present parameters. In other situations, the coolant circulation system 66 may not be flowing coolant, in which case the control signals may cause the system 66 to initiate flow and heat rejection of the coolant.

In addition to performing the acts represented by blocks 116 and 118, the control circuit 62 may also send control signals to one or more electrodes that control electron beam emission by the thermionic emitter 14 to initiate the electron beam (block 120). In one possible implementation, the flux of the electron beam 18 may be lower than the flux utilized for imaging until the target 16 reaches a suitable imaging temperature. It should be noted that the electron beam emission (block 120) may be performed substantially simultaneously with or after the rotation of the SGB 90 (block 116).

In this regard, while the concept of adjusting the rotation rate of the SGB 90 (block 116) is presently discussed prior to the concept of setting or adjusting the coolant circulation system 66 (block 118), it should be noted that the adjustment of the illustrated operational parameters 114 may be performed in any sequence, and is not limited to the particular sequence illustrated. However, it should be noted that it may be desirable to rotate the SGB 90 (block 116) prior to initiation of the electron beam 18 (block 120) so as to avoid damaging the target 16.

To ensure that the components controlled by the control circuit 62 are at suitable operational levels, the control circuit 62 may continuously and/or intermittently detect and/or model the various parameters (block 122), such as temperatures. As an example, the control circuit 62 may have modeled temperature data for a given set of operational parameters (i.e., coolant flow rate and temperature, SGB rotation rate, electron beam flux, and so on). In a time-series model, the control circuit 62 may maintain and/or adjust the operational parameters at given times until the model suggests that the target 16 has reached a suitable operating temperature. Additionally or alternatively, the control circuit 62 may have detected temperature data from other components of the X-ray tube 64 that are indicative (e.g., proportional) to the temperature of the target 16, or the actual temperature of the target 16 may be measured.

Once the control circuit 62 has modeled and/or determined the temperature of the target 16, the control circuit 62 may perform a query as to whether the target 16 has reached a suitable operating temperature (query 124). In embodiments where the target 16 has not reached a suitable operating temperature, the method 110 may cycle back to adjusting the operational parameters 114 until the target 16 has reached a suitable temperature. In other embodiments, the method 110 may simply continue monitoring in accordance with block 122. In embodiments where the target 16 has indeed reached a temperature suitable for imaging, the control circuit 62 may send control signals to various components of the thermal control system 60 to maintain the temperature of the target 16 (block 126).

The acts represented by block 126 may include sending control signals to the electrodes that control the thermionic emitter 14 to stop electron beam emission, as well as to the SGB 90 to either maintain, increase, or decrease its rotation rate. Additionally or alternatively, the control circuit 62 may send control signals to the coolant circulation system 66. As an example, the control circuit 62 may re-adjust the position of the flow control valve 74 to adjust coolant mass flow rates to various sections of the X-ray tube 64, the speed of the heat exchanging fan 72 to adjust heat rejection of the coolant, and/or the power of the coolant pump 70 to adjust the overall coolant mass flow rate. The temperature maintenance of the target 16 by the thermal control system 66 is described in further detail hereinbelow.

FIG. 5 illustrates a process flow diagram of an embodiment of a method 130 for temperature maintenance between and during X-ray imaging routines. As noted above, acts within method 130 may be performed automatically by the control circuit 62 and/or may be initiated by a user. To begin the method 130, various parameters are detected and/or modeled (block 132), the feedback of which is provided to the control circuit 62 in a similar manner as discussed above with respect to FIG. 4. The acts represented by block 132 may include detecting and/or modeling various temperatures of the components within the X-ray tube 64 such as the target 16, the sleeve 84, the stationary shaft 86, and the SGB 90. Further, other parameters may be directly measured, such as the coolant temperature and/or coolant flow rate. Since the imaging system (e.g., imaging system 10 of FIG. 1) may be in use or between uses while method 130 is being performed, the rotation rate of the gantry (e.g., rotational subsystem 34) may also be measured. It may be desirable to account for the rotation rate of the gantry such that a suitable flux of the electron beam 18, and thus flux of the X-ray beam 20 (FIG. 1), may be provided. Accordingly, the electron beam 18 may or may not be utilized as a part of the thermal control system 60 while imaging is being performed.

As discussed above, the feedback provided to the control circuit 62 may determine the control of various operational parameters (block 134). The control of various operational parameters according to block 134 generally includes but is not limited to setting the rotation rate of the SGB 90 (block 136), setting the output of the heat exchanger pump 70 (block 138), setting the speed of the heat exchanger fan 72 (block 140), and/or setting the position of the flow control valve 74 (block 142). It should be noted that any one or a combination of these operational parameters may be adjusted in any order, and not necessarily in the order set forth in the process flow diagram of FIG. 5.

Once at least one of the components of the thermal control system 60 has been adjusted or if no adjustments are required, the control circuit 62 may then perform a determination as to whether an exposure is to be performed (query 144). In embodiments where an exposure is indeed to be performed, the exposure may be conducted (block 146). As an example, the control circuit 62 (or the X-ray controller of FIG. 1) may provide control signals to the electrodes of the thermionic emitter 14 to initiate emission of the electron beam 18.

After the exposure has been conducted, the control circuit 62 may then again detect and/or model one or more parameters (e.g., temperatures of the components of the X-ray tube 64) (block 148). As an example of how the temperatures of one or more components of the X-ray tube 64 may be detected and/or modeled after imaging, the control circuit 62 may account for the flux of the electron beam 18, i.e., the power at which the imaging routine is performed, the duration of the imaging routine, and the settings of the thermal control system 60. Alternatively or additionally, the control circuit 62 may receive temperature data from one or more components of the X-ray tube 64 from which the temperature of the target 16 may be extrapolated, may receive temperature data from the target 16, or a combination of these.

In embodiments where no exposure is to be performed, the method 130 would directly progress to detecting/modeling various parameters (e.g., temperatures) continuously and/or intermittently (block 148). It should be noted that whether exposure is performed or not, the acts represented by block 148 may be performed to ascertain one or more parameters of the X-ray tube components. Based on the detection and/or modeling resulting from the acts represented by block 148, the control circuit 62 may then ascertain whether the modeled and/or detected parameters are within a suitable range (query 150). In embodiments where the detected and/or modeled parameters are within a suitable range, the method 130 may continue operation with substantially no change to the operational parameters (block 152). However, in embodiments where at least one of the detected and/or modeled parameters is not within a suitable range, the method may cycle back to controlling various operational parameters (block 134).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system for thermal control of an X-ray tube, comprising:

an X-ray tube having an electron beam target, a rotary bearing supporting the target in rotation, and a coolant flow passage, at least a portion of the coolant flow passage being disposed in the center of the rotary bearing, and the coolant flow passage is configured to receive a coolant;

a coolant circulating system coupled to the coolant flow passage and configured to circulate the coolant thorough the coolant flow passage; and a control circuit coupled to the coolant circulating system and the rotary bearing, the control circuit being configured to control heat flow between components of the X-ray tube by regulating extraction of heat from the X-ray tube via the coolant and by regulating a rotation rate of the rotary bearing.

2. The system of claim 1, wherein the components of the X-ray tube comprise the electron beam target and the rotary bearing supporting the target in rotation.

3. The system of claim 2, wherein the control circuit is configured to regulate coolant flow and the rotation rate of the rotary bearing during at least one phase of operation of the X-ray tube to cause heat to flow from the rotary bearing to the target in response to a modeled and/or measured parameter relating to a temperature of the components within the X-ray tube.

4. The system of claim 3, wherein the control circuit is configured to regulate coolant flow and the rotation rate of the rotary bearing to cause heat to flow from the rotary bearing to the target at least until the target transitions from a brittle phase to a ductile phase.

5. The system of claim 3, wherein the control circuit is configured to regulate coolant flow and rotation rate of the rotary bearing during a second phase of operation of the X-ray tube to cause heat to flow from the target to the rotary bearing.

6. The system of claim 1, wherein the coolant circulation system comprises a variable speed pump, and the variable speed pump is configured to control a rate of flow of the coolant in response to control signals from the control circuit.

7. The system of claim 1, wherein the coolant circulation system comprises a heat exchanging fan, and the heat exchanging fan is configured vary heat rejection from the coolant in response to control signals from the control circuit.

8. The system of claim 1, wherein the coolant circulation system comprises a flow control valve, and the flow control valve is configured to vary the flow rate of coolant through different sections of the X-ray tube in response to control signals from the control circuit.

9. The system of claim 1, wherein the control circuit is configured to control the rotation rate of the rotary bearing based upon a speed of rotation of a gantry in which the X-ray tube is disposed.

10. The system of claim 9, wherein the control circuit is configured to regulate extraction of heat from the X-ray tube via the coolant based upon the speed of rotation of the gantry.

11. The system of claim 10, wherein the control circuit is configured to regulate extraction of heat from the rotary bearing to increase the load-bearing capability of the rotary bearing during operation of the X-ray tube and the gantry.

12. The system of claim 11, wherein the control circuit is configured to maintain a temperature of the target so as to eliminate a user-initiated warmup of the target between X-ray examinations.

13. The system of claim 1, wherein the rotary bearing comprises a spiral groove bearing having a bearing sleeve rotatable about a stationary shaft, the rotary bearing having a liquid metal material disposed between the bearing sleeve and the stationary shaft, and wherein the center of the stationary shaft comprises the portion of the coolant flow path.

14. An imaging system, comprising:

a system for thermal control of an X-ray tube, comprising:

an X-ray tube having an electron beam target, a rotary bearing supporting the target in rotation, and a coolant flow passage, at least a portion of the coolant flow passage being disposed in the center of the bearing, and the coolant flow passage is configured to receive a coolant;

a coolant circulating system coupled to the coolant flow passage and configured to circulate the coolant thorough the coolant flow passage;

a digital detector configured to receive radiation from the X-ray tube transmitted through a subject of interest;

an image acquisition circuit configured to control acquisition of image data from the detector; and a control circuit coupled to the coolant circulating system and the rotary bearing, the control circuit being configured to control heat flow between components of the X-ray tube by regulating the extraction of heat from the X-ray tube via the coolant and by regulating a rotation rate of the rotary bearing.

15. The system of claim 14, wherein the X-ray tube and the digital detector are disposed on a gantry for rotation about the subject.

16. The system of claim 14, wherein the components of the X-ray tube comprise the electron beam target and the rotary bearing supporting the target in rotation.

17. The system of claim 16, wherein the control circuit is configured to regulate coolant flow and the rotation rate of the rotary bearing during at least one phase of operation of the X-ray tube to cause heat to flow from the rotary bearing to the target.

18. The system of claim 17, wherein the control circuit is configured to regulate coolant flow and the rotation rate of the rotary bearing to cause heat to flow from the rotary bearing to the target at least until the target transitions from a brittle phase to a ductile phase.

19. The system of claim 16, wherein the control circuit is configured to regulate coolant flow and the rotation rate of the rotary bearing during a second phase of operation of the X-ray tube to cause heat to flow from the target to the rotary bearing.

20. A method for thermal control of an X-ray tube, comprising:

rotating a rotary bearing supporting an electron beam target in rotation at a rotation rate to generate heat;

extracting heat from the X-ray tube via coolant circulated through the X-ray tube;

monitoring a parameter indicative of a temperature within the X-ray tube; and controlling heat flow between components of the X-ray tube by regulating the extraction of heat from the X-ray tube via the coolant and by regulating the rotation rate of the rotary bearing.

21. The method of claim 20, comprising adjusting the rotation rate of the rotary bearing, the extraction of heat via the coolant, or both, in response to the parameter.

22. The method of claim 20, wherein regulating extraction of heat comprises regulating a flow rate of the coolant circulated through the X-ray tube.

23. The method of claim 20, wherein regulating extraction of heat comprises regulating heat rejection from the coolant circulated through the X-ray tube.

24. The method of claim 20, wherein regulating extraction of heat comprises regulating the flow of the coolant circulated through sections of the X-ray tube.

25. The method of claim 20, wherein the heat extraction via the coolant is regulated and the rotation rate of the rotary bearing is adjusted to cause heat to flow from the rotary bearing to the target at least until the target transitions from a brittle phase to a ductile phase.

26. The method of claim 20, wherein the heat extraction via the coolant is regulated and the rotation rate of the rotary bearing is adjusted during a phase of operation of the X-ray tube to cause heat to flow from the target to the rotary bearing.

* * * * *